United States Patent [19]

Sasaki

[11] Patent Number: 4,634,121

[45] Date of Patent: Jan. 6, 1987

[54] BAT SWING PRACTICE MEANS

[76] Inventor: Yuuki Sasaki, 6-11-10, Tsukamoto,, Yodogawa-ku, Osaka-shi, Japan

[21] Appl. No.: 763,699

[22] Filed: Aug. 8, 1985

[30] Foreign Application Priority Data

Aug. 23, 1984 [JP] Japan ..... 59-128195[U]
Jan. 21, 1985 [JP] Japan ..... 60-007063[U]

[51] Int. Cl.[4] ..... A63B 69/36

[52] U.S. Cl. ..... 273/26 B; 272/124; 273/186 A; 273/194 B

[58] Field of Search ..... 273/81 A, 26 R, 29 A, 273/186 A, 186 R, 202, 197 A, 194 A, 193 A, 194 B; 272/117, 124; 403/326, 379, 108

[56] References Cited

U.S. PATENT DOCUMENTS

| | | | |
|---|---|---|---|
| 1,418,401 | 6/1922 | Schmidt | 272/186 A |
| 3,136,546 | 6/1964 | Connolly | 273/186 A |
| 3,342,489 | 9/1967 | Waldo | 273/81 A |
| 3,502,329 | 3/1970 | Brazier | 272/117 |
| 4,027,886 | 6/1977 | Katsube | 273/186 A |
| 4,029,312 | 6/1977 | Wright | 272/124 |
| 4,377,125 | 3/1983 | Westfall | 273/186 A |

FOREIGN PATENT DOCUMENTS

| | | | |
|---|---|---|---|
| 442206 | 3/1927 | Fed. Rep. of Germany | 272/12 X |
| 622320 | 4/1949 | United Kingdom | 272/117 |

*Primary Examiner*—Richard C. Pinkham
*Assistant Examiner*—T. Brown
*Attorney, Agent, or Firm*—Larson and Taylor

[57] ABSTRACT

A bat swing practice device comprising a shaft body having a predetermined length to be swung, a weight axially slidably put on the shaft body, and structure for engaging and disengaging the weight with and from the shaft body, the structure including a plurality of engagement holes formed in the shaft body at intervals and an engagement projection on the weight, the projection adapted to be resiliently engaged with and disengaged from any one of the engagement holes in the shaft body.

2 Claims, 6 Drawing Figures

BAT SWING PRACTICE MEANS

BACKGROUND OF THE INVENTION

Bat swing practice means of various kinds have been conventionally proposed and used. For example, there is known a bat swing practice means in which a weight having a predetermined weight value is slidably put on a bat-shape shaft body to be swung. The position of the weight engaged with the shaft body is adjustable so that the distance between a grip of the shaft body and the engagement position of the weight can be adjusted. The center of gravity of the bat can therefore be adjusted dependent on the ability of the user. In such practice means, the weight is fitted to the shaft body by threadedly connecting the screw shaft portion of the shaft body to a threaded hole in the weight. The weight is fixed to the shaft body with a lock nut engaged with the screw shaft. In handling such practice means, the user encounters the following problems.

In order to adjust the distance between the weight and the grip by sliding the weight, it is required to rotate the weight. The adjustment thus takes time. If the weight has not been secured sufficiently with the lock nut, the weight tends to move unexpectedly when the bat is swung. If the weight has been secured too much, the rotating operation of the lock nut required for sliding adjustment of the weight becomes difficult.

SUMMARY OF THE INVENTION

The present invention relates to improvements in bat swing practice means.

It is a main object of the present invention to provide a bat swing practice means in which a weight having a predetermined weight value is slidably put on a shaft body to be swung and means is disposed for engaging and disengaging the weight with and from the shaft body easily and securely, so that the weight position can be readily adjusted and the weight can be readily engaged with and disengaged from the shaft body.

It is another object of the present invention to provide a bat swing practice means in which the means for engaging and disengaging the weight with and from the shaft body has a leaf spring so constructed as not come off when the engaging/disengaging operation is made, thereby to improve the maneuverability.

The bat swing practice means in accordance with the present invention comprises a shaft body having a predetermined length to be swung, a weight axially slidably put on the shaft body, and means for engaging and disengaging the weight with and from the shaft body, said means including a plurality of engagement holes formed in the shaft body at intervals, and an engagement projection on the weight adapted to resiliently engage and disengage with and from one of the engagement holes in the shaft body.

According to the bat swing practice means constructed as above-mentioned, the projection of the weight can be engaged with any one of the engagement holes so that the weight can be secured to the shaft body at the position of the hole. The resilient engagement of the projection with the engagement hole assures fixation of the weight to the shaft body. The projection can be disengaged from the engagement hole against spring resiliency, thus facilitating the axial sliding adjustment of the weight with respect to the shaft body.

According to the bat swing practice means of the present invention, the user can easily accomplish the sliding adjustment of the weight and can easily engage and disengage the weight with and from the shaft body. The distance between the grip of the shaft body and the weight can therefore be easily changed and adjusted. The weight acting on the grip can therefore be easily adjusted, permitting the user to practice bat swing with optimum weight.

DETAILED DESCRIPTION OF THE PREFERRED EMBODIMENT

The bat swing practice means in accordance with the present invention comprises a shaft body having a predetermined length to be swung, a weight axially slidably put on the shaft body, and means for engaging and disengaging the weight with and from the shaft body.

The shaft body 1 to be swung is provided at the base thereof with a grip 2 of a predetermined shape and at the head thereof opposite to the base with a stopper 4 for preventing a weight 3 put on the shaft body 1 from coming off when the bat is swung.

Figure 1:
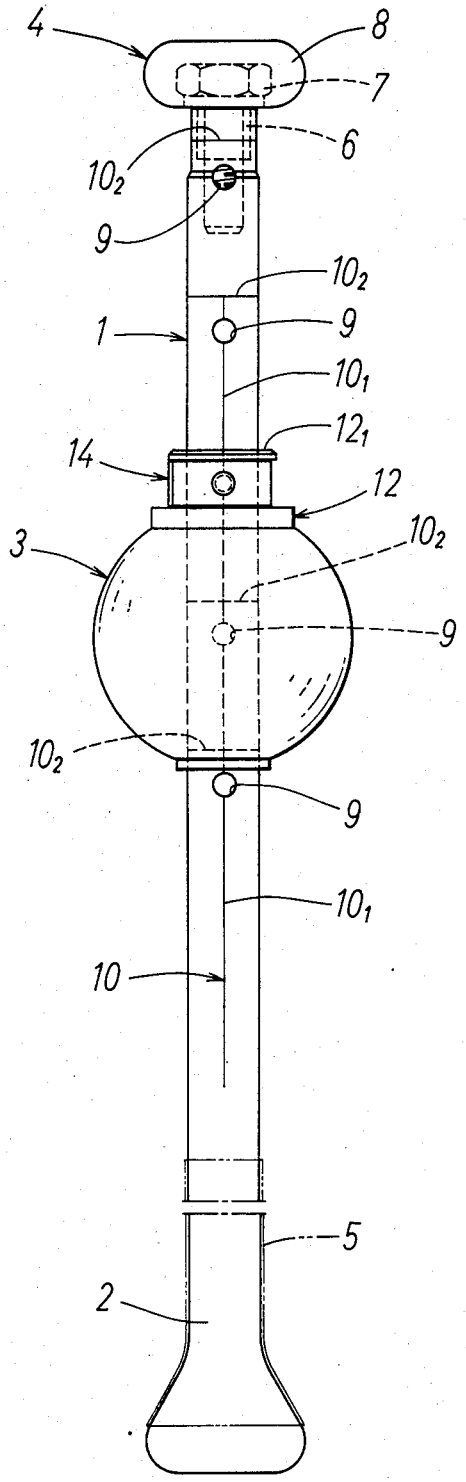
FIG. 1 is a front view with portions omitted of bat swing practice means in accordance with the present invention.
Figure 2:
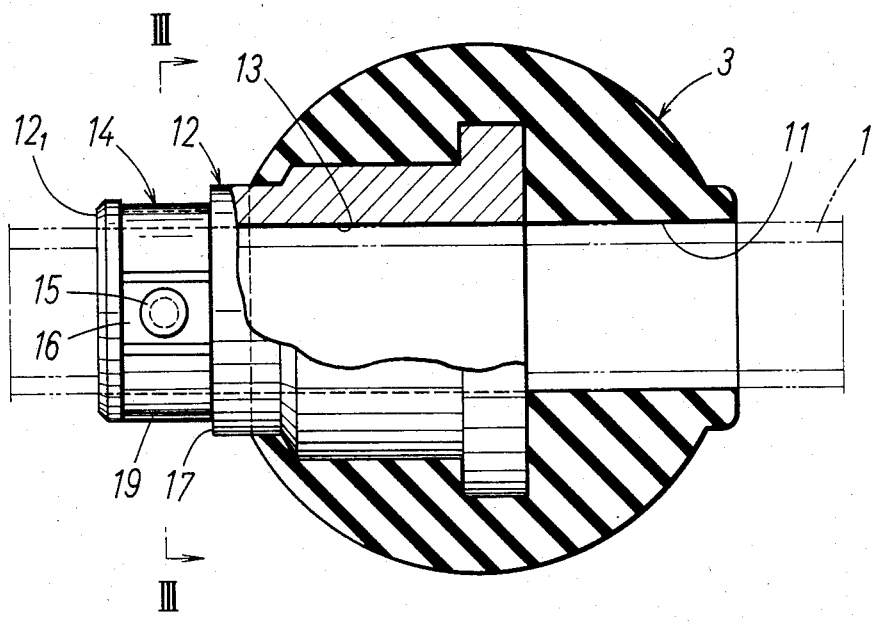
FIG. 2 is an enlarged front view with portions broken away of a weight and engaging and disengaging means.

The grip 2 is covered with a suitable nonskid coating film 5. The stopper 4 includes a nut 6 secured to the shaft body 1 and a stopper bolt 7 removably attached to the nut 6. The head of the stopper bolt 7 is covered with a resilient member 8 for safety purposes. The shaft body 1 has, at regular intervals, a plurality of engagement holes 9 extending in the direction at right angle to the axial direction of the shaft body 1. The shaft body 1 has on the surface thereof guide lines 10 to be used when sliding the weight 3. As shown in FIG. 1, the guide lines 10 are preferably constituted by a line $10_1$ extending in the axial direction of the shaft body 1 and passing through the centers of the engagement holes 9, and lines $10_2$ extending in the circumferential direction of the shaft body 1, these lines $10_2$ being used when slidably positioning the weight 3.

The weight 3 may be made of, for example, a resilient material such as rubber, and formed into a spherical shape, thus assuring the safety when the bat is swung. The weight 3 has in the center thereof a through-hole 11 into which the shaft body 1 is inserted. The weight 3 has a sleeve 12 projecting from the upper end of the weight 3. A through-hole 13 in the sleeve 12 has the same diamter as that of the through-hole 11 in the weight 3, and communicates with the through-hole 11 in a straight line. The through-holes 11 and 13 form an insertion hole in which the shaft body 1 is inserted.

The engaging and disengaging means 14 comprises engagement holes 9 in the shaft body 1 and an engagement projection 15 resiliently secured to the weight 3. The projection 15 is adapted to resiliently engage with and disengage from any one of the engagement holes 9 in the shaft body 1.

Figure 3:
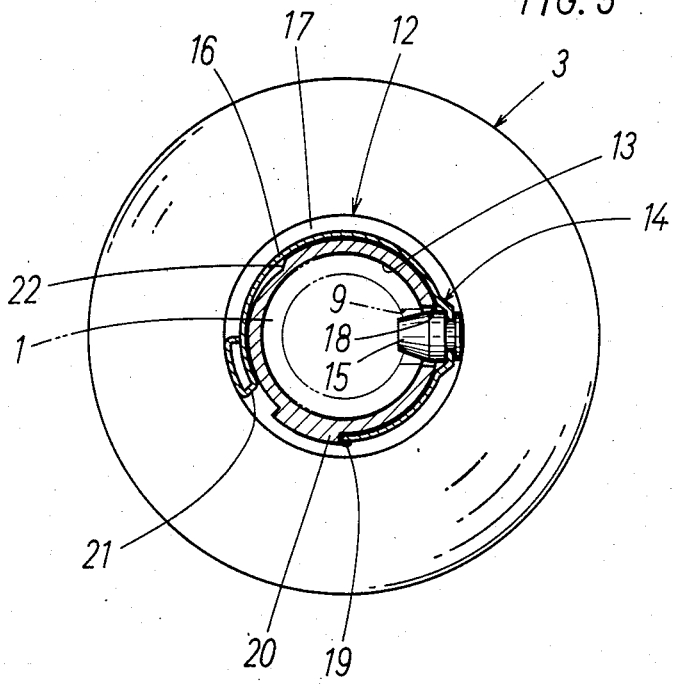
FIG. 3 is a section view taken along the line III—III of FIG. 2.
Figure 4:
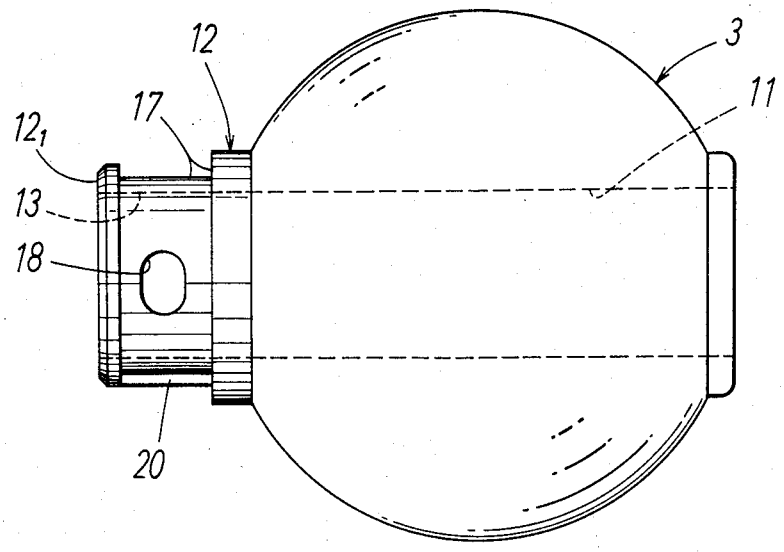
FIG. 4 is a front view of the weight.

The engagement projection 15 is secured to a loop-shape leaf spring 16 having resiliency, which is resiliently fitted in a peripheral groove 17 in the projecting end of the sleeve 12 secured to the weight 3. As shown in FIGS. 3 to 6, the peripheral groove 17 has a hole 18 for receiving the projection 15. When the leaf spring 16 is fitted in the peripheral groove 17 with the projection 15 engaged with the hole 18, the base end 19 of the leaf spring 16 is adapted to come in contact with the peripheral groove 17 at the end step portion 20. At this time, the projection 15 secured to the leaf spring 16 and the base end 19 are located so as to be substantially perpendicular to each other when viewed from the center of the through-hole 13 in the sleeve 12 (FIG. 3).

Figure 5:
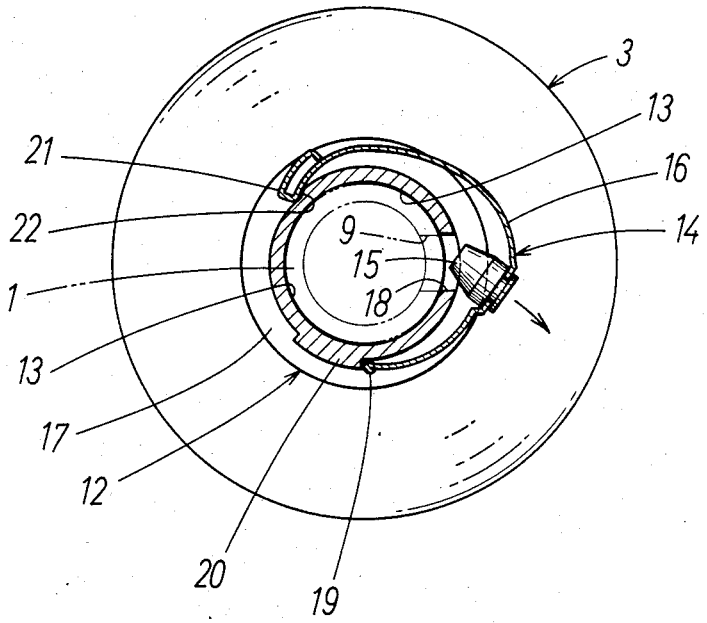
FIG. 5 is a view illustrating how the engaging and disengaging means work.
Figure 6:
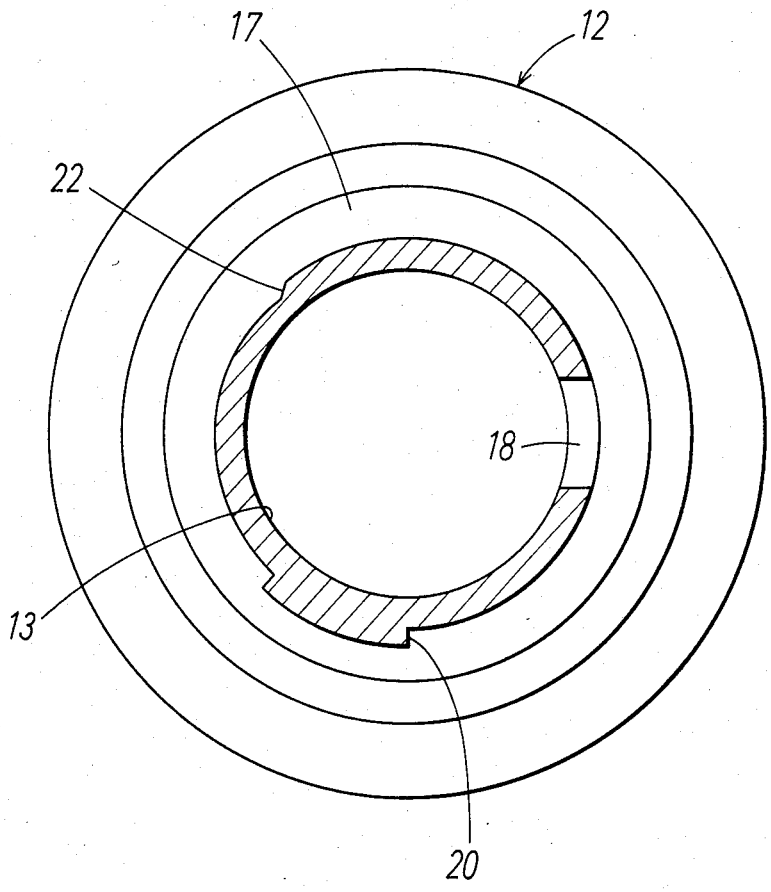
FIG. 6 is an enlarged section view of a sleeve for mounting a leaf spring on the engaging and disengaging means.

While the leaf spring 16 is fitted in the peripheral groove 17 by its resiliency, a finger placing portion 21 of a suitable shape is disposed at the other end of the leaf spring 16 opposite to the base end 19. The rotation of the portion 21 toward the base end 19 causes the leaf spring 16 to be resiliently deformed with the base end 19 serving as a fulcrum. With the resilient deformation of the leaf spring 16, the projection 15 secured to the leaf spring 16 is then moved from the inside of the hole 18 in the peripheral groove 17 toward the outside (FIG. 5). The peripheral groove 17 has at the bottom thereof a stopper 22 having a stage portion for restraining the resilient deformation of the leaf spring 16 in a predetermined range. This stopper 22 is disposed on the bottom of the peripheral groove 17 at such position that the finger placing portion 21 of the leaf spring 16 does not exceed the diametrical line passing through the through-hole 13 in the sleeve 12 and the base end 19 when the leaf spring 16 is resiliently deformed. When the leaf spring 16 is resiliently deformed, the finger placing portion 21 of the leaf spring 16 is stopped as contacted with the stopper 22, thus securely preventing the leaf spring 16 from coming off from the peripheral groove 17. The stopper 22 is located at such position that the projection 15 of the leaf spring 16 is moved to the outside with respect to the inner peripheral surface of the through-hole 13 in the sleeve 12 when the finger placing portion 21 of the leaf spring 16 comes in contact with the stopper 22.

The following description will discuss the operation of the embodiment of the present invention constructed as above-mentioned.

The bat swing practice means in accordance with the present invention can be used in the same manner as a normal bat. When the user swings the bat at the head portion thereof with the grip 2 of the shaft body 1 held, weight corresponding to the distance between the weight 3 and the grip 2 of the shaft body 1 acts on the grip 2. If this weight is too heavy or light to the user, the position of the weight engaged with the shaft body 1 can be changed toward the grip 2 or the head. Weight acting on the grip 2 can therefore be adjusted according to the distance between the weight 3 and the grip 2.

When changing the engaging position of the weight 3, the finger placing portion 21 of the leaf spring 16 can be rotated to resiliently deform the leaf spring 16 with the base end 19 serving as a fulcrum. The projection 15 of the leaf spring 16 is then moved to the outside so that the projection 15 is disengaged from the engagement hole 9 in the shaft body 1 (FIG. 5). The weight 3 is then axially slid and the projection 15 is engaged with a desired engagement hole 9 in the shaft body 1 with the use of a resilient resetting force of the leaf spring 16.

For sliding the weight 3, the projection 15 of the leaf spring 16 can be slid along the axial guide line $\mathbf{10}_1$ in the shaft body 1. For securing the weight 3 to the shaft body 1, the end face $\mathbf{12}_1$ of the sleeve 12 secured to the weight 3 can be fitted to a desired one of the peripheral guide lines $\mathbf{10}_2$. Sliding and fixing of the weight 3 can be thus accomplished easily and securely.

When resiliently deforming the leaf spring 16 to disengage the projection 15 from the engagement hole 9 in the shaft body 1, the finger placing portion 21 of the leaf spring 16 is securely stopped as contacted with the stopper 22, thereby to prevent the leaf spring 16 from coming off from the peripheral groove 17.

The engagement and disengagement of the weight 3 with and from the shaft body 1 can be thus accomplished easily, and coming-off of the leaf spring 16 can be securely prevented, thereby to improve the maneuverability.

A preferred embodiment of the present invention has been discussed just by way of example. The present invention is not limited to this embodiment, but modifications or variations thereof can be included in the present invention without departing from the scope of the appended claims.

What is claimed is:

1. A bat swing practice means comprising a shaft body having a predetermined length to be swung, a weight axially slidably put on said shaft body, and means for engaging and disengaging said weight with and from said shaft body, said means including a plurality of engagement holes formed in said shaft body at spaced intervals therealong and an engagement projection on said weight, said projection being adapted to be resiliently engaged with and disengaged from any one of said engagement holes in said shaft body, said weight including a peripheral groove, and said engagement projection being secured to a loop-shape leaf spring resiliently fitted in said peripheral groove.

2. A bat swing practice means as set forth in claim 1 wherein a stopper for preventing the leaf spring from coming off is formed in the peripheral groove in the weight.

* * * * *